US010857580B2

(12) United States Patent
Aran

(10) Patent No.: US 10,857,580 B2
(45) Date of Patent: Dec. 8, 2020

(54) METHOD FOR PRODUCING GUN BARRELS AND APPARATUS FOR PERFORMING SUCH METHOD

(71) Applicant: Repkon Machine and Tool Industry and Trade Inc., Sile—Istanbul (TR)

(72) Inventor: Ayet Azer Aran, Kadiköy-Istanbul (TR)

(73) Assignee: Repkon Machine and Tool Industry and Trade Inc., Istanbul (TR)

( * ) Notice: Subject to any disclaimer, the term of this patent is extended or adjusted under 35 U.S.C. 154(b) by 0 days.

(21) Appl. No.: 16/066,365

(22) PCT Filed: Jan. 27, 2017

(86) PCT No.: PCT/EP2017/051773

§ 371 (c)(1),
(2) Date: Jun. 27, 2018

(87) PCT Pub. No.: WO2017/157556

PCT Pub. Date: Sep. 21, 2017

(65) Prior Publication Data

US 2019/0015885 A1 Jan. 17, 2019

(30) Foreign Application Priority Data

Mar. 17, 2016 (TR) ..... TR2016/03523

(51) Int. Cl.
*B21C 37/15* (2006.01)
*F41A 21/18* (2006.01)
(Continued)

(52) U.S. Cl.
CPC ..... *B21C 37/153* (2013.01); *F41A 21/16* (2013.01); *F41A 21/18* (2013.01); *B21D 22/16* (2013.01)

(58) Field of Classification Search
CPC ..... F41A 21/16; F41A 21/18; B21C 37/152; B21C 37/153; B21D 22/16
(Continued)

(56) References Cited

U.S. PATENT DOCUMENTS 2,397,544 A * 4/1946 Garand ..... B21C 37/153 72/96
3,177,688 A * 4/1965 Kralowetz ..... F41A 21/18 72/21.5

(Continued)

FOREIGN PATENT DOCUMENTS

| | | | |
|---|---|---|---|
| EP | 0614712 | A1 | 9/1994 |
| EP | 2210682 | A1 | 7/2010 |
| WO | 2011012766 | A1 | 2/2011 |

OTHER PUBLICATIONS

WIPO, International Search Report (for the parent application), dated Apr. 5, 2017.

*Primary Examiner* — Stephen Johnson
*Assistant Examiner* — Benjamin S Gomberg
(74) *Attorney, Agent, or Firm* — Laurence P. Colton; Smith Tempel Blaha LLC

(57) ABSTRACT

A method and apparatus for producing gun barrels having a grooved or ribbed inner surface with straight or helical grooves or ribs, by providing a metallic hollow cylindrical pre-form, placing the pre-form on a core mandrel being part of a flow forming machine having a main machine axis, the core mandrel having a structured outer surface comprising ribs and/or grooves extending straightly parallel to and/or helically around the main axis; and applying forming rollers, in a roller arrangement, to the outside surface of the pre-form so as to apply radial pressure on the pre-form such that its material begins to flow. As the rollers apply force upon the pre-form, a relative motion between the pre-form and the rollers is performed by moving the pre-form in axially parallel to the main axis through the roller arrangement or by moving the roller arrangement alongside the pre-form.

11 Claims, 5 Drawing Sheets

(51) Int. Cl.
*F41A 21/16* (2006.01)
*B21D 22/16* (2006.01)

(58) Field of Classification Search
USPC ..... 42/76.1, 78
See application file for complete search history.

(56) References Cited

U.S. PATENT DOCUMENTS 3,753,365 A * 8/1973 Kralowetz ..... B21J 5/12 72/76
3,893,321 A * 7/1975 Braunwieser ..... B21J 7/14 72/76
4,428,222 A * 1/1984 Ramnesten ..... B21C 37/153 470/84
4,429,561 A * 2/1984 Ramnesten ..... B21C 37/153 470/84
4,646,618 A * 3/1987 Kurth ..... B29C 67/0014 89/1.816
5,388,329 A * 2/1995 Randlett ..... B21C 3/16 29/890.049
7,934,332 B2 * 5/2011 Briggs ..... F41A 21/02 29/520
8,776,425 B2 * 7/2014 Pelin ..... B21H 1/18 42/76.1
8,910,409 B1 * 12/2014 Fonte ..... F41A 21/20 148/519
8,997,541 B2 * 4/2015 Nillies ..... B21D 22/16 72/85
2012/0090372 A1 * 4/2012 Nillies ..... B21C 37/26 72/85

* cited by examiner

METHOD FOR PRODUCING GUN BARRELS AND APPARATUS FOR PERFORMING SUCH METHOD

CROSS REFERENCE TO RELATED APPLICATIONS

This application claims the benefit of and is the US National Phase of International Application No. PCT/EP2017/051773 having an International Filing Date of 27 Jan. 2017, which claims the benefit of Turkish Patent Application No. 2016/03523 having a filing date of 17 Mar. 2016.

BACKGROUND OF THE INVENTION

Technical Field

The present invention relates to a new manufacturing method for gun barrel manufacturing. Gun barrels within the meaning of this invention include mortar cannon barrels, rifle barrels and also covers any shape which is used in the barrel manufacturing including air, naval, military, security & police forces and personal gun barrels including the sportive gun barrels.

Prior Art

Such gun barrels are usually hollow pipe like structures that comprise helical or straight groves and/or ribs (and/or different shaped profiles) that are usually formed on the inside surface of the structure.

Such barrels are usually manufactured by either a milling process in which the inside structure is formed by removing material from inside of a workpiece to form ribs or grooves. The other possible way is a forging process in order to produce the desired inside shape of the workpiece. Both methods do produce gun barrels in the desired shape, but the products produced still suffer from various disadvantages. One setback is that the precision and shape of the grooves and ribs produced as mentioned above is rather poor and not durable. This entails lack of performance on the finished produced involving such gun barrels.

BRIEF SUMMARY OF THE INVENTION

An object of the present invention is to provide a superior method and an apparatus for producing rifled and/or inside shaped gun barrels, which reduced the setbacks set forth above.

A further object of the invention is to provide a forming method and an apparatus that are simple in application, inexpensive to manufacture, and highly effective in operation.

The above objects are solved by a method for producing gun barrels having a grooved or ribbed inner surface with straight or helical grooves or ribs, the method comprising the steps of:

providing a metallic hollow cylindrical pre-form;

placing the pre-form on a core mandrel being part of a flow forming machine having a main machine axis, the core mandrel being not driven and being freely rotatable about the main axis and having a structured outer surface comprising ribs and/or grooves, the ribs and/or grooves extending straightly parallel to and/or helically around the main axis;

applying forming rollers comprised in a roller arrangement, to the outside surface of the pre-form so as to apply radial pressure on the pre-form such that its material begins to flow; and as the rollers apply force upon the pre-form, performing a relative motion between the pre-form and the rollers by either moving the pre-form in axial direction parallel to the main axis through the roller arrangement or by moving the roller arrangement alongside the pre-form, and an apparatus for producing gun barrels having a grooved or ribbed inner surface with straight or helical grooves or ribs, the apparatus comprising:

a head stock;

a tail stock opposing the head stock;

a core mandrel extension rod rotatably supported in the head stock;

a driving means for driving said core mandrel extension rod to rotate about a main machine axis;

a core mandrel being rotatably supported on a free end of the core mandrel extension rod, the core mandrel being freely rotatable with respect to the core mandrel extension rod about the main machine axis; and a set of forming rollers provided between the head stock and the tail stock, the rollers being radially displaceable toward the core mandrel in order to apply a radial force onto a cylindrical pre-form placed on the core mandrel, wherein the core mandrel has a structured outer surface comprising ribs and/or grooves, the ribs and/or grooves extending straightly parallel to and/or helically around the main machine axis.

Favorable embodiments can be found in the respective subclaims.

The invention provides a method for producing gun barrels having a grooved or ribbed inner surface with straight or helical grooves or ribs. Rather than forging or milling the inside structure, the present invention involves flow forming technique in order to achieve the desired result.

According to the present invention, the method is carried out on a flow forming machine and comprises the following steps:

providing a metallic hollow cylindrical pre-form;

placing the pre-form on a core mandrel being part of a flow forming machine having a main machine axis, the core mandrel being not driven and being freely rotatable about the main axis and having a structured outer surface comprising ribs and/or grooves, the ribs and/or grooves extending straightly parallel to and/or helically around the main axis;

applying forming rollers comprised in a roller arrangement, to the outside surface of the pre-form so as to apply radial pressure on the pre-form such that its material begins to flow;

as the rollers apply force upon the pre-form, performing a relative motion between the pre-form and the rollers by either moving the pre-form in axial direction parallel to the main axis through the roller arrangement or by moving the roller arrangement alongside the pre-form.

The pre-form (starting material) may be closed or semi closed bottom shaped or can be open end on both sides. The pre-form can be an un-machined raw material (extruded pipe, welded or seamless tubes etc.) and/or a turned/machined part. Any type of flow formable material can be used as pre-form.

In one embodiment, the axial position of the rollers is kept fixed such that that the rollers lie in a predetermined position above the core mandrel between both axial ends of the core mandrel. Favorably, the pre-form is pushed in axial direction over the core mandrel towards the tail stock of the machine. The roller induced flow of material of the pre-form will fill the grooves and the spaces between ribs of the core mandrel and the mandrel will rotate in case the pressure is too high. As the pre-form is gradually pushed through the rollers applying pressure on the pre-form, the diameter of the pre-form is at the same time reduced and the inside contour is shaped. The barrel contours or shapes can vary anything from helical or straight groves or ribs, from rather shallow profiles to very steep or aggressive profiles.

As compared to conventional methods, to produce gun barrels, like hammer forging, button rifling and cut rifling (broaching, reaming, lapping) processes, the involvement of flow forming technique on a shaped core mandrel entails the following advantages:

Due to cold work hardening effect, the material properties of the produced workpiece can be improved. In longitudinal (axial) direction, the grains of the material can be refined and directed. Further, light weight barrel design is possible, as the ultimate tensile strength of the workpiece is improved. Further, usage of material can be reduced as machining processes for obtaining inside grooves are reduced or even eliminated (e. g. reaming, broaching, etc.). The method of the invention further provides for achieving finest geometrical tolerances for inside groves or ribs and produces minimized residual stress in the workpiece due to the continuous and smooth forming process. Other physical properties such as an excellent inner surface roughness, an improved straightness, improve cylindricity, and improved roundness tolerances are achieved as well.

A further advantage is a better material hardness variation along wall thickness which is also due to the continuous processing method of flow forming.

The core mandrel may also have a tapered shape, so that gun barrels with a slightly conical inner surface may be produced which promise less wear of material and thus a longer duration in use. In this case, the rollers and/or the core mandrel are designed to perform a limited relative motion with respect to one another. This relative motion may, however, be limited to a relative axial motion of the rollers between both axial ends of the core mandrel.

The apparatus for performing the method stipulated above, is a flow forming machine, which comprises:

a head stock, a tail stock opposing the head stock, a core mandrel extension rod rotatably supported in the head stock, and a driving means for driving said core mandrel extension rod to rotate about a main machine axis. The apparatus further comprises a core mandrel that is rotatably supported on a free end of the core mandrel extension rod. As such, the core mandrel is freely rotatable with respect to the core mandrel extension rod about the main machine axis of the flow forming machine. The apparatus further includes a set of forming rollers that are provided between the head stock and the tail stock. The rollers are radially displaceable toward the core mandrel in order to apply a radial force onto a cylindrical pre-form that is placed on the core mandrel. The core mandrel has a structured outer surface which comprises ribs and/or grooves. The ribs and/or grooves extend straightly parallel to and/or helically around the main machine axis. These ribs or grooves are a negative image on the actual inner contour to be shaped into the inside wall of the pre-form.

Favorably, the core mandrel extension rod and the rollers can be displaceable with respect to each other in a horizontal direction parallel to said main machine axis. Only a relative motion between both the rollers and the pre-form is required. This can be achieved by enabling the core mandrel extension rod and/or the rollers to be displaceable with respect to the head stock in a horizontal direction parallel to said main machine axis. During operation, the relative motion feeds the pre-form through the set of rollers which radially press onto the outside surface of the pre-form. This results in a shaping process that on the one hand reduces the wall thickness and lengthens the pre-form, on the other hand shapes the inner surface of the pre-form to receive the ribs or grooves.

Preferably, the core mandrel comprises a substantially cylindrical shape with said ribs and/or grooves formed on or in its outer surface. This is for forming cylindrical workpieces out of a cylindrical pre-form.

Alternatively, the core mandrel comprises a substantially conical shape with said ribs and/or grooves formed on or in its outer surface and tapering in the direction of the tail stock. This mandrel form is designed for forming cylindrical tapered workpieces out of a cylindrical pre-form.

According to another embodiment, the tailstock comprises a tail stock extension rod extending in the direction of the main machine axis and being rotatably supported by the tail stock to rotate about the main machine axis. In this configuration, the tailstock extension rod is held against the free end of the core mandrel. During the forming process the pre-form is elongated due to the reduction of its wall thickness and "grows" in length such that it is pushed over the core mandrel towards the tail stock onto the tailstock extension rod.

The tail stock extension rod is preferably displaceable in horizontal direction parallel to the main machine axis and extends coaxially with said core mandrel extension rod and said core mandrel. After forming, the finished workpiece can be unloaded from the machine by retracting the tail stock extension rod. This way, the workpiece is quickly and simply ejected from the forming mandrel after the part is formed.

After forming process the part is formed in accordance with the mandrel shape and forming roller path programmed on the machine control panel. The inside and outside contours can be vary in shape and/or different diameter zones can be created according to defined part program. Some of the possible geometries are illustrated in FIGS. 7*a* through 7*d*, but the method is not limited to these geometries. The inside and outside contours can have a conical (and/or concave) shape.

BRIEF DESCRIPTION OF THE DRAWINGS

The invention is described hereinafter with reference to the attached drawings depicted in FIGS. 1 through 8*c:*

DETAILED DESCRIPTION OF THE PREFERRED EMBODIMENT

Figure 1:
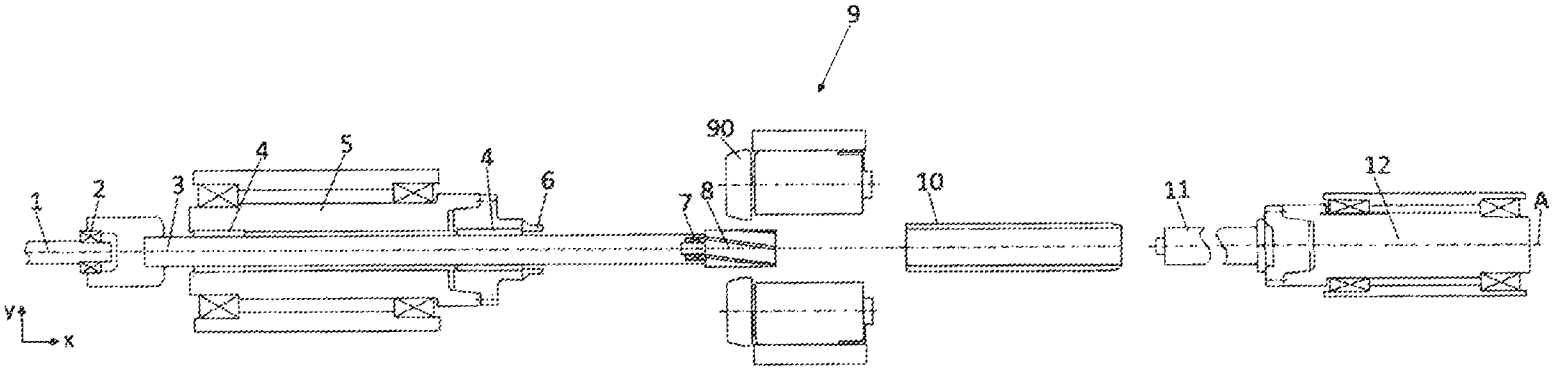
FIG. 1 shows a side and sectional view of the apparatus according to the invention in a loading position.
Figure 2:
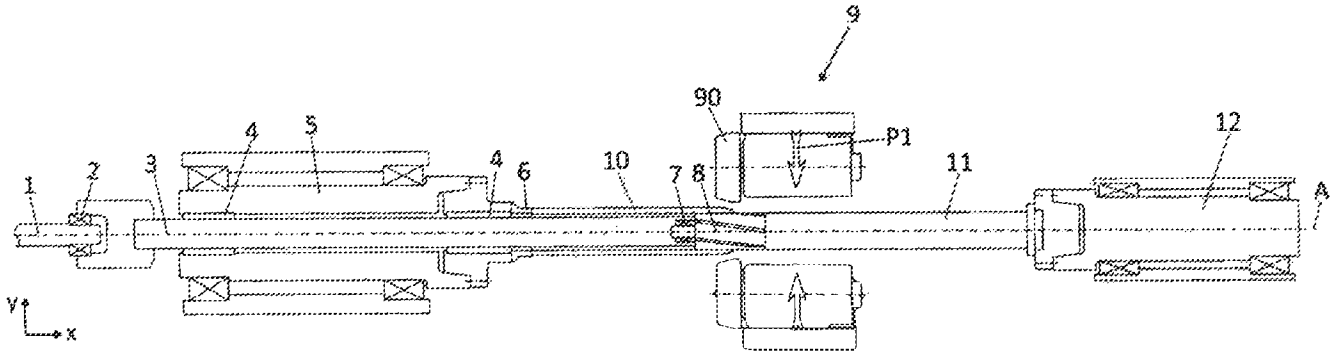
FIG. 2 shows a side and sectional view of the apparatus according to the invention with the pre-form having been set onto the mandrel prior to applying the forming rollers.

FIGS. 1 through 6 show a basic configuration of a flow forming machine which is an apparatus of the present invention. The axis A is the main machine axis.

Drive 1 is designed to drives the core mandrel unit in axial direction X (positive and negative axial direction). The drive 1 may have position and/or force control capabilities. The movement of the drive 1 is independent from the axial movement of headstock 5. In some applications, the drive may be located onto the moveable parts of the headstock 5. In this case, the core mandrel 8 moves in accordance to the motion of headstock 5 to achieve the requested part geometries.

The drive can be isolated from the rotational movements of core mandrel extension rod 3 via a bearing 2. In some cases, the core mandrel axial drive 1 may rotate together or in accordance with the core mandrel extension rod 3. Preferably, the core mandrel extension rod 3 is a solid bar or hollow shaft which is located between the core mandrel 8 and the axial drive 1. The main function of core mandrel extension rod 3 is to keep and/or move the core mandrel 8 in the correct and pre-determined position during or prior to or after the forming process. Such action requires programming which can be made mechanically, e.g. via relay system, PLC or CNC or any other control device. According the requirements of the process, the extension rod 3 may either be guided in axial direction X and/or radial direction Y by the headstock 5—using a bearing 4—or alternatively by the tailstock 12. Depending on the requirements of the process, the extension rod 3 can be actuated in rotational direction via headstock 5, tailstock 12 and/or any other drive units.

The headstock 5, that comprises a spindle unit, is movable in axial direction X and drives the pre-form 10 through the forming rollers 90 comprised in the roller unit 9, over the core mandrel 8 during the forming process.

The pre-form 10 is driven in rotational direction about axis A via drive ring 6 and/or tapered part and/or any transmission device which is connected to headstock's 5 spindle. The headstock spindle 5 is actuated by common or separate actuation devices (e.g. electrical motor, hydro motor, etc.). Depending on the process requirements, the headstock 5 can be used to pull the pre-form parts 10 through the roller unit 9 (instead of pushing) to form the part in the aforementioned way. The headstock 5 and tailstock 12 units can interchange their functions.

Figure 8:
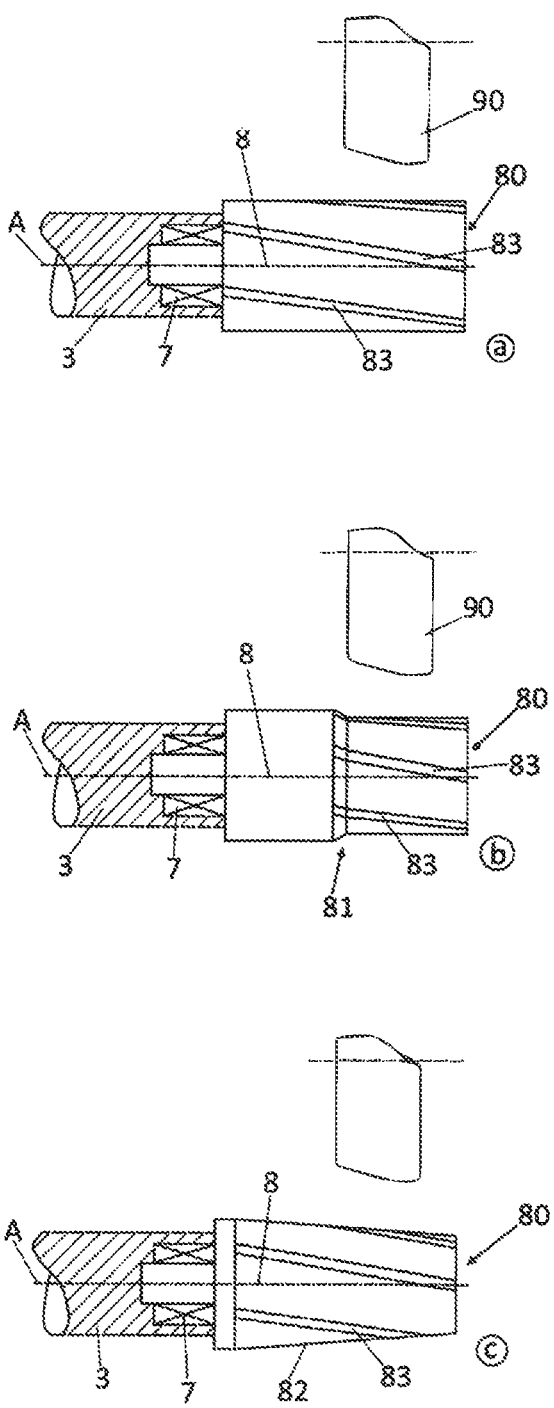
FIG. 8*a* shows a close up view of the apparatus according to the invention in the vicinity of the core mandrel with a first embodiment of the core mandrel.
FIG. 8*b* shows a view similar to FIG. 8*a* with a second embodiment of the core mandrel.
FIG. 8*c* shows a view similar to FIG. 8*a* or 8*b* with a third embodiment of the core mandrel.

As shown in FIG. 8, the core mandrel 8 can be a mandrel which is tapered or conical in shape (FIG. 8*c*), it can have single diameter (FIG. 8*a*) or multi diameters (FIG. 8*b*) on single and/or multi-part forming mandrel.

The core mandrel 8 forms the free end of the core mandrel extension rod and is freely rotatable via a bearing 7 and/or a guiding device and it will follow the axial position, i.e. the axial movement, of the core mandrel axial drive 1 system. Core mandrel 8 is not actively (e.g. by a controlled rotational drive) actuated in the rotational direction which means that the formed section of the material 10 flows under the radial pressure of the applied rollers 90 and the flow of material accordingly turns the mandrel in rotational direction. The core mandrel 8 is guided on the extension rod 3 via bearing 7 and/or another guiding system. The core mandrel 8 can be centered by using a centering device located on the machine frame, using a lunette, or involving the tailstock 12 and/or headstock 5 as a centering device. The core mandrel 8 may be non-cooled or internally and/or externally cooled using any cooling media.

As stated above, some of the possible geometries of the core mandrel 8 are illustrated in FIG. 8 (FIG. 8*a*-single diameter flat mandrel, FIG. 8*b*-multi diameter flat mandrel with a step 81 forming a transition region between two diameters, FIG. 8*c*-conical mandrel with a conical surface 82). The mandrels 8 preferably have a profiled contour with ribs or/and grooves 83 in the mandrel's 8 outer surface extending parallel to or at angle with the main machine axis A. but the mandrel geometries regarding this method is not limited to these geometries. Reference numeral 80 depicts the free end of the core mandrel 8.

The method according to the invention employs a roller unit 9 with one or more forming rollers 9 to form the barrel. The forming rollers 90 are actuated by axial and/or radial direction using a not shown machine control system. Each roller 90 can be actuated separately or all rollers 90 can be synchronized to move together using the control system. The forming rollers 90 can be free in rotational direction or be actuated by any drive system. The forming rollers 90 can vary in shape and dimensions and/or they can have an offset in axial direction X and/or radial direction Y. The forming position (axial and/or radial) of the rollers 90 can be changed during the forming process via the control system. Each forming roller 90 may have an angle referenced to machine central axis A. This angle can be adjusted automatically via the control system and/or manually. The roller 90 can be used for a stripping function and/or separate stripping devices can be employed.

The tailstock spindle unit 12 is movable in axial direction X and the main function of the tailstock 12 is to guide the pre-form 10 in axial direction X and/or radial direction and/or pull or push the pre-form to assist the process flow. The tailstock spindle 12 can be freely rotatable in rotational direction (about axis A) or can be actuated via separate actuation devices (electrical motor, hydro motor, etc.). The tailstock 12 and headstock 5 may interchange their functions.

The inventive method works as follows: a cylindrical, hollow metallic pre-form 10 is placed over the mandrel 8 and the extension rod 3 to abut against the drive ring 6, FIG. 3. In this situation, the machine is loaded and the tail stock extension rod 11 is moved by the tailstock 12 in axial direction X to abut against the free end of the core mandrel. Now core mandrel extension rod 3, core mandrel 8, and tailstock extension rod 11 form a unit that may be moved as a unit in axial direction. As such, this unit is moved relatively to the rollers 90 in axial direction such that a predetermined axial starting position is reached in which the rollers 90 lie radially above the free end of the pre-form 10 and are axially located at the position of the core mandrel 8. The free end of the pre-form 10 refers to the end of the pre-form 10 not abutting the drive ring 6. The rollers 90 are now moved radially inward (P1) to apply pressure onto the pre-form, FIG. 3.

Figure 3:
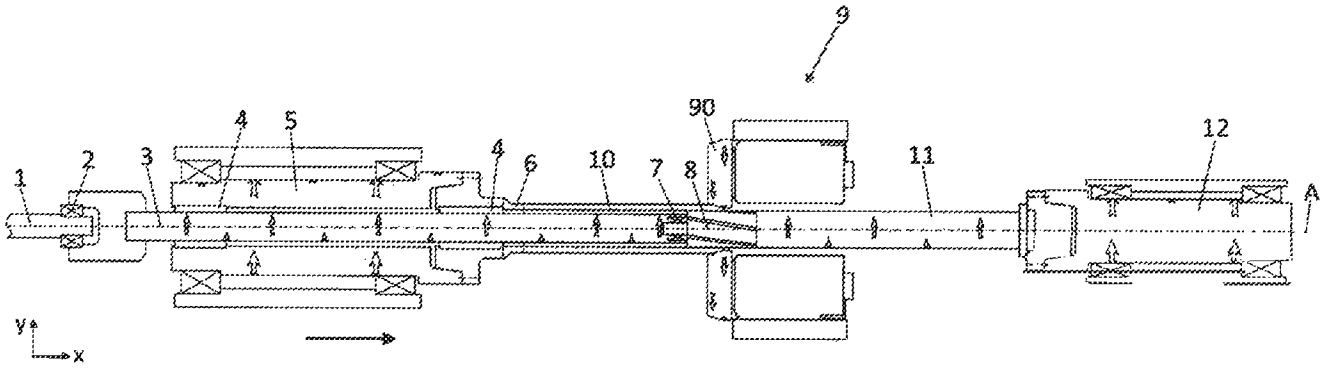
FIG. 3 shows a similar view of the apparatus according to the invention at the beginning of applying the forming rollers to the pre-form.
Figure 4:
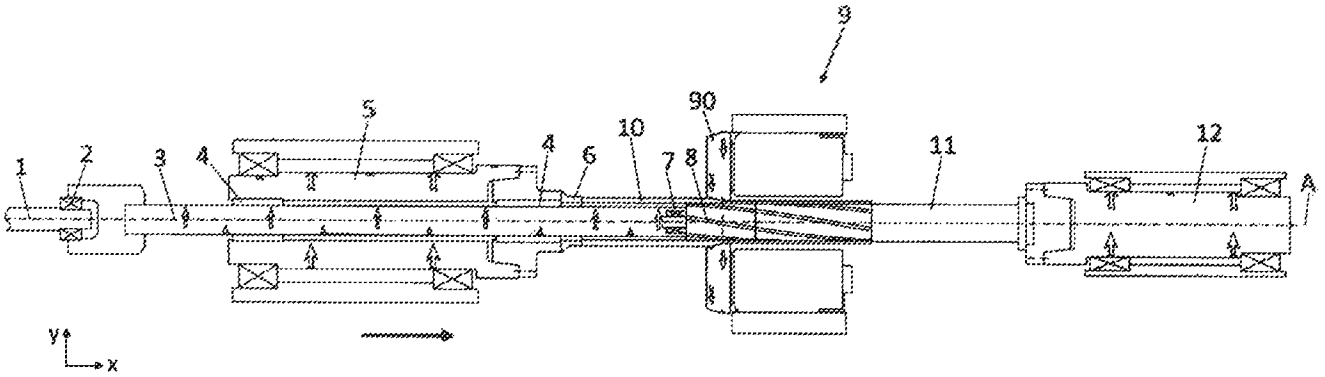
FIG. 4 shows a similar view of the apparatus according to the invention during applying the forming rollers to the pre-form.
Figure 5:
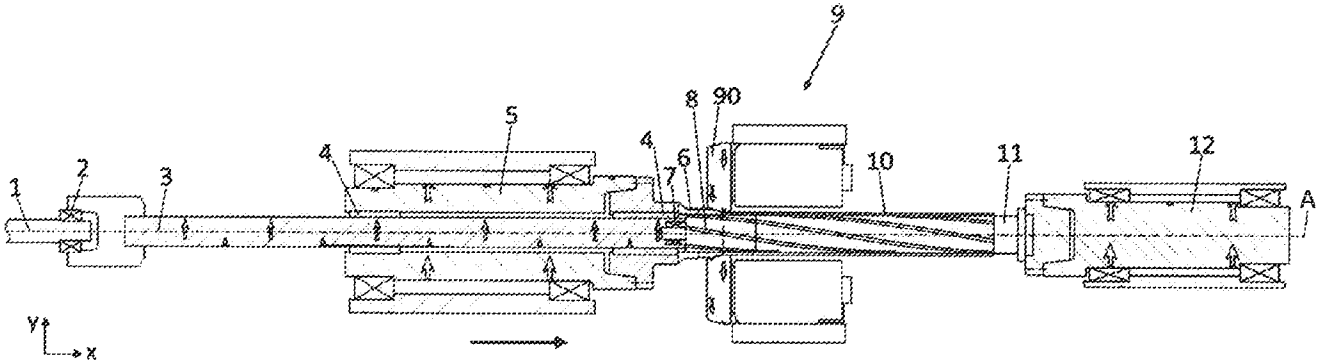
FIG. 5 shows a similar view of the apparatus according to the invention at the end of applying the forming rollers to the pre-form.
Figure 6:
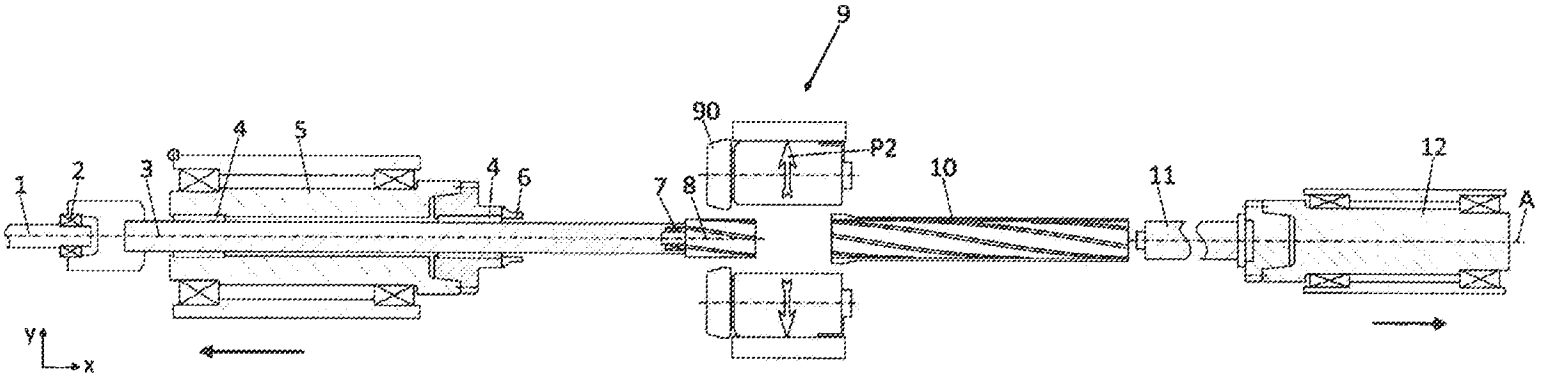
FIG. 6 shows a similar view of the apparatus according to the invention unloading the finished workpiece.
Figure 7:
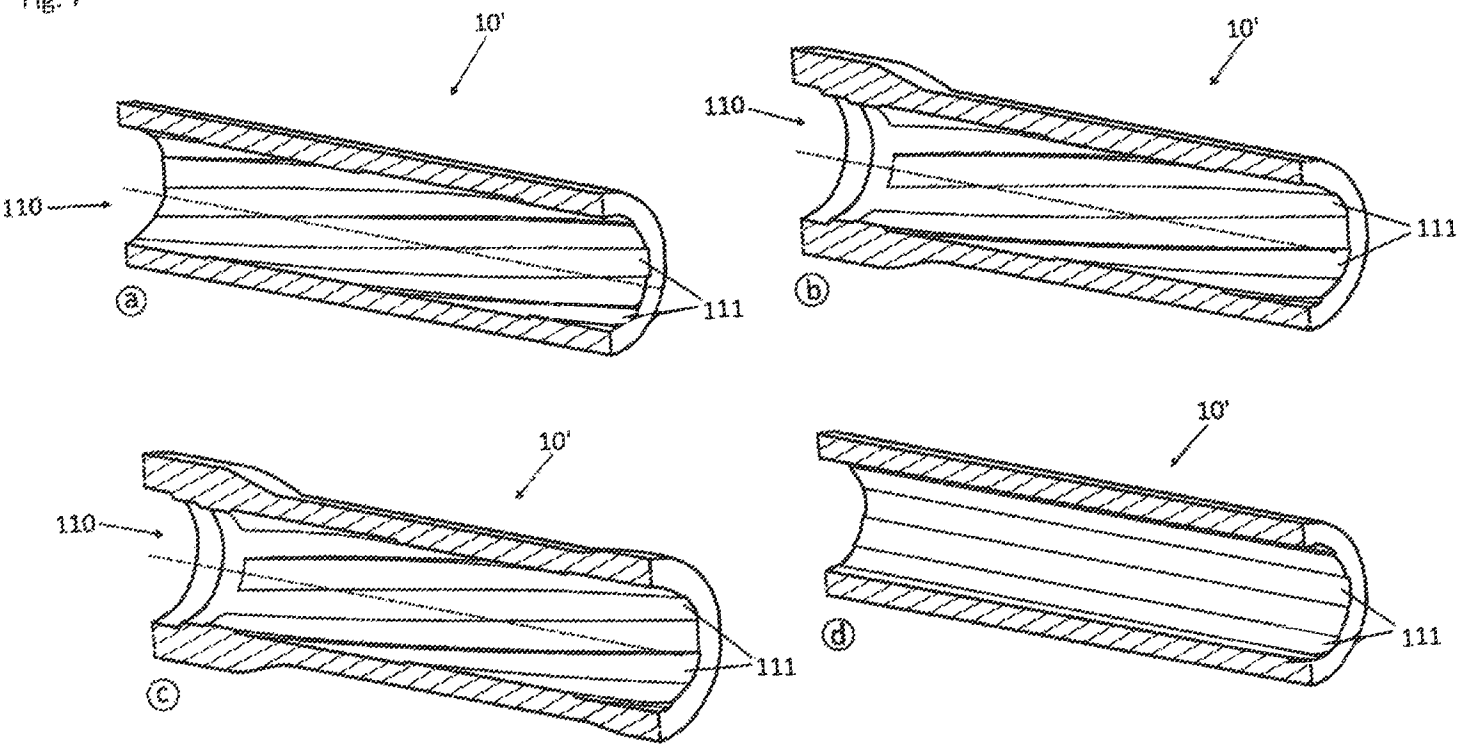
FIG. 7*a* shows a perspective sectional view of a first workpiece manufactured by the inventive method.
FIG. 7*b* shows a perspective sectional view of a second workpiece manufactured by the inventive method.
FIG. 7*c* shows a perspective sectional view of a third workpiece manufactured by the inventive method.
FIG. 7*d* shows a perspective sectional view of a fourth workpiece manufactured by the inventive method.

As the rollers 90 apply pressure they are turned as indicated by the arrows in FIGS. 3 and 4. At the same time, the pre-form 10 is driven radially by the headstock 5 by means of the drive ring 6 and set into relative motion with respect to the rollers in axial direction by means of the axial drive 1. As the rollers 90 apply pressure, the material of the pre-form 10 starts flowing which results in a reduced outer diameter of the part of the pre-form 8 that has passed through the roller unit 90, shown in FIGS. 4 and 5. At the same time, the inner surface of the pre-form is shaped as well, as material flowing into the space between the core mandrel 8 and the pre-form 10. Depending on the particular structure of ribs and/or grooves on the outside surface of the core mandrel 8, the inner surface of the pre-form adapts a negative shape of this structure. This is indicated by the helical profile of the pre-form 10 in FIGS. 5 and 6 and in the examples shown in FIGS. 7*a*-7*d*. FIGS. 7*a*-7*d* also illustrate finished workpieces (10'), namely gun barrels having a grooved or ribbed inner surface (110) with straight or helical grooves (111) or ribs. After the forming process is completed, the rollers 90 are moved radially outward (P2) and the tailstock 12 disengages its extension rod 11 from the free end of the core mandrel. After this, the finished workpiece 10, 10' can be unloaded from the machine

What is claimed is:

1. A method for producing gun barrels having a grooved or ribbed inner surface (110) with straight or helical grooves or ribs, the method comprising the steps of:

providing a metallic hollow cylindrical pre-form (10);

placing the pre-form (10) on a core mandrel (8) being rotatably supported on a free end of a core mandrel extension rod (3) being rotatably supported in a head stock, wherein the core mandrel (8) is a part of a flow forming machine having a main machine axis (A) and a tail stock extension rod (11) being rotatably supported in a tail stock (12) and which is displaceable in a horizontal axial direction (X) parallel to the main machine axis (A) and extending coaxially with the core mandrel extension rod (3) and the core mandrel (8), wherein the core mandrel extension rod (3), the core mandrel (8), and the tailstock extension rod (11) form a unit that is movable in the axial direction (X), the core mandrel (8) being both not driven and freely rotatable about the main axis (A) and having an outer surface comprising ribs (83) or grooves, the ribs (83) or grooves extending parallel to or helically around the main axis (A);

applying forming rollers (90) comprised in a roller arrangement (9), to an outside surface of the pre-form (10) so as to apply radial (P1) pressure on the pre-form (10) such that material of which the pre-form (10) is made begins to flow; and as the rollers (90) apply force upon the pre-form (10), performing a relative motion between the pre-form (10) and the rollers (90) by either moving the pre-form (10) in the axial direction (X) parallel to the main axis (A) through the roller arrangement (9) or by moving the roller arrangement (9) alongside the pre-form (10).

2. The method according to claim 1, wherein an axial position of the rollers (90) is fixed such the rollers (90) lie in a predetermined position above the core mandrel (8) between both axial ends of the core mandrel (8).

3. The method according to claim 1, wherein the core mandrel (8) has a tapered shape (82), and the rollers (90) and the core mandrel (8) perform a limited relative motion with respect to one another, the limited relative motion being limited to a relative axial motion of the rollers (90) between both axial ends of the core mandrel (8).

4. The method according to claim 1, wherein the flow forming machine comprises:

the head stock (5);

the tail stock (12), which is in a position opposing the head stock (5);

the core mandrel extension rod (3), which is rotatably supported in the head stock (5);

a driving means (1) for driving the core mandrel extension rod (3) in the axial direction (X) along the main machine axis (A);

the core mandrel (8), which is freely rotatable with respect to the core mandrel extension rod (3) about the main machine axis (A); and the forming rollers (90), which are provided between the head stock (5) and the tail stock (12), the rollers (90) being radially displaceable toward the core mandrel in order to apply the radial (P1) pressure onto the pre-form (10) placed on the core mandrel (8), wherein the tail stock (12) and the tail stock extension rod (11) extend along the main machine axis (A) and the tail stock extension rod (11) is rotatably supported by the tail stock (12) so as to rotate about the main machine axis (A).

5. The method according to claim 4, wherein the core mandrel extension rod (3) and the rollers (90) are displaceable with respect to each other in the axial direction (X) parallel to the main machine axis (A).

6. The method according to claim 5, wherein the core mandrel (8) is cylindrical with the ribs (83) or grooves formed on or in the outer surface.

7. The method according to claim 5, wherein the core mandrel (8) is conical with the ribs (83) or grooves formed on or in the outer surface and tapering in a direction of the tail stock (12).

8. The method according to claim 4, wherein at least one of the core mandrel extension rod (3) and the rollers (90) is displaceable with respect to the head stock (5) in the axial direction (X) parallel to the main machine axis (A).

9. The method according to claim 8, wherein the core mandrel (8) is cylindrical with the ribs (83) or grooves formed on or in its the outer surface.

10. The method according to claim 8, wherein the core mandrel (8) is conical with the ribs (83) or grooves formed on or in the outer surface and tapering in a direction of the tail stock (12).

11. The method according to claim 1, whereby a gun barrel having a grooved or ribbed inner surface (110) with straight or helical grooves (111) or ribs is produced.

* * * * *